US006634874B2

(12) United States Patent
Bush et al.

(10) Patent No.: US 6,634,874 B2
(45) Date of Patent: Oct. 21, 2003

(54) SCROLL COMPRESSOR WITH ANTI-REVERSE ROTATION CLUTCH

(75) Inventors: James W. Bush, Skaneateles, NY (US); John R. Williams, Bristol, VA (US); Zili Sun, Arkadelphia, AR (US); Carlos Zamudio, Arkadelphia, AR (US); Jason Hugenroth, Hope, AR (US); Gregory W. Hahn, Arkadelphia, AR (US); Thomas R. Barito, Arkadelphia, AR (US); Joseph T. Hill, Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/167,312

(22) Filed: Jun. 11, 2002

(65) Prior Publication Data

US 2002/0150490 A1 Oct. 17, 2002

Related U.S. Application Data

(63) Continuation-in-part of application No. 09/725,425, filed on Nov. 29, 2000, now abandoned.

(51) Int. Cl.[7] ..... F04C 18/04; F16D 15/00; F16D 63/00

(52) U.S. Cl. ..... 418/55.1; 418/69; 188/82.1; 192/215

(58) Field of Search ..... 418/55.1, 69; 188/69, 188/82.1, 82.8; 192/12 B, 215

(56) References Cited

U.S. PATENT DOCUMENTS

| | | | |
|---|---|---|---|
| 4,998,864 | A | 3/1991 | Muir |
| 5,545,019 | A | 8/1996 | Beck et al. |
| 5,593,294 | A | 1/1997 | Houghtby et al. |

FOREIGN PATENT DOCUMENTS

| | | | |
|---|---|---|---|
| JP | 60-73078 | A | 4/1985 |

*Primary Examiner*—John J. Vrablik
(74) *Attorney, Agent, or Firm*—Carlson, Gaskey & Olds

(57) ABSTRACT

A low cost protective clutch member is positioned adjacent an end of the drive shaft in a scroll compressor. The device is a thin washer having a tab which is selectively driven against the housing stop when the compressor is driven in a forward direction, but is movable into a notch in the shaft when the shaft is driven in a reverse direction. The tab prevents rotation of the shaft when in the notch.

10 Claims, 2 Drawing Sheets

SCROLL COMPRESSOR WITH ANTI-REVERSE ROTATION CLUTCH

This is a continuation-in-part of U.S. Ser. No. 09/725,425, filed Nov. 29, 2000, abandoned.

BACKGROUND OF THE INVENTION

This application relates to a scroll compressor wherein a clutch prevents rotation of a powered shaft in a reverse direction.

Scroll compressors are becoming widely utilized in refrigerant compression applications. In a scroll compressor, a pair of scroll members each include a base and generally spiral wrap extending from the base. The wraps interfit to define compression chambers. A shaft drives one of the two scroll members to orbit relative to the other. As the one orbits, the size of the compression chambers is decreased. A refrigerant entrapped in the compression chambers is compressed.

Scroll compressors raise many design challenges. One design challenge occurs at shutdown. When a scroll compressor is stopped, refrigerant which may be trapped at centrally located compression chambers may expand. This can cause the orbiting scroll member to be driven in an opposed direction to that in which it is typically driven. This is an occurrence known as reverse rotation, and is somewhat undesirable. Reverse rotation can result in undesirable noise, etc.

One means of preventing such reverse rotation is the use of a one-way clutch, which typically is placed around an upper portion of the shaft, and prevents the orbiting scroll from being driven in the reverse direction. However, one other type of reverse rotation occurs if the motor for the scroll compressor is miswired. If this occurs, then it is possible the scroll compressor will be driven at high speeds in the reverse direction.

With the prior art clutch, when the scroll compressor is driven at a high torque and speed in the reverse direction, the clutch can sometimes fail.

It is thus the goal of this invention to develop a scroll compressor wherein there is a safety to protect the clutch in the event of powered reverse rotation.

SUMMARY OF THE INVENTION

In the disclosed embodiment of this invention, a clutch is positioned at a location such that it acts to prevent reverse rotation of the shaft of the scroll compressor. When the compressor is rotated in a forward direction the device is moved to a normal position at which it does not interfere with the rotation of the shaft. However, if the shaft should be driven in the reverse direction it then prevents further rotation of the shaft.

In one embodiment, the clutch is provided by a washer positioned at an end of the shaft remote from the compressor pump unit. The washer preferably provides a thrust force along the length of the shaft. The washer has a tab which is brought into contact with a stop on a housing when driven in a forward position. The tab is driven into a notch in the shaft to prevent reverse rotation of the shaft when driven reverse rotating occurs. Friction between the shaft and the washer causes the washer to move between the two positions.

The washer is preferably mounted within a housing bore in a housing member, which may also be a lower bearing mount. The washer has a smaller size than the housing bore, such that the washer can move between these two positions.

These and other features of this invention will be best understood from the following specification and drawings, the following of which is a brief description.

DETAILED DESCRIPTION OF A PREFERRED EMBODIMENT

Figure 1:
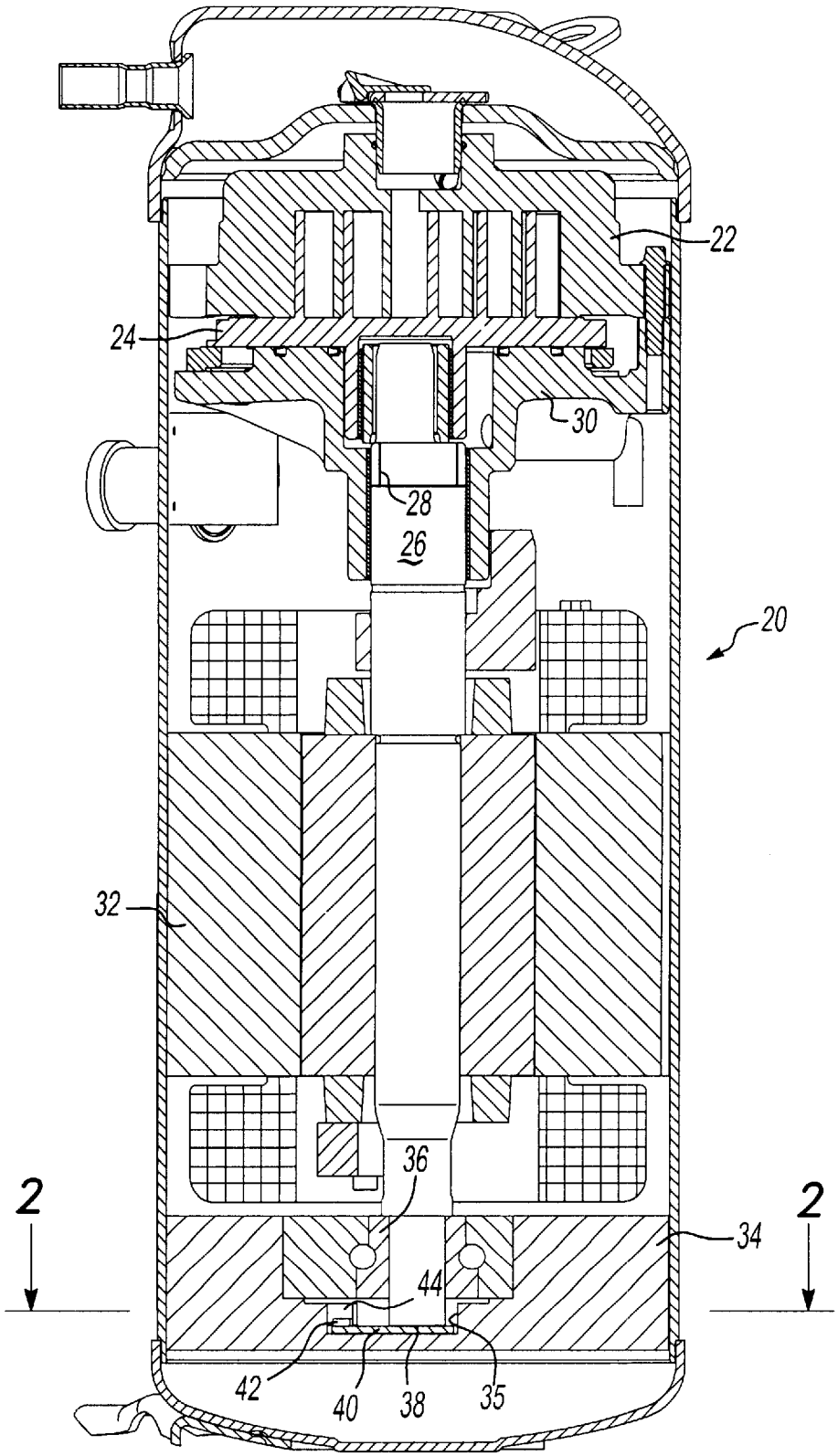
FIG. 1 is a cross-sectional view of a scroll compressor incorporating this invention.

FIG. 1 shows a scroll compressor 20 incorporating a non-orbiting scroll 22 interfitting with an orbiting scroll 24. As known, a shaft 26 drives the orbiting scroll 24. A clutch 28 is shown schematically and positioned between the orbiting scroll 24 and a crankcase 30. The clutch will prevent rotation of the orbiting scroll in a reverse direction. A motor 32 drives the shaft 26. As is known, the clutch 28 will prevent unpowered reverse rotation of the orbiting scroll 24, by preventing the orbiting scroll from moving in the reverse rotation. However, problems have sometimes arisen when the shaft 26 is driven in the reverse direction, and the clutch 28 has sometimes failed in those circumstances.

Obviously, the clutch 28 is shown here in a highly schematic fashion. The present invention is directed to a secondary clutch that will either be used in combination with the clutch 28 as a preventative safety feature, or which may have some benefits in itself. The structure of the clutch 28 is preferably of the sort utilized in compressors manufactured by Copeland Corporation. Different types of such clutches are illustrated in several patents owned by Copeland Corporation.

The present invention thus incorporates a device to prevent rotation of the shaft 26 when it is driven to rotate in the reverse direction. First, a bearing mount 34 mounts a bearing 36 near a remote end of the shaft 26 from the compressor pump unit. A thrust washer 40 is received within a bore 35 in the bearing mount 34. The washer 40 applies a bias force upwardly into the shaft 26. A tab 42 is shown positioned adjacent a stop 44 from the bearing mount 34.

Figure 2:
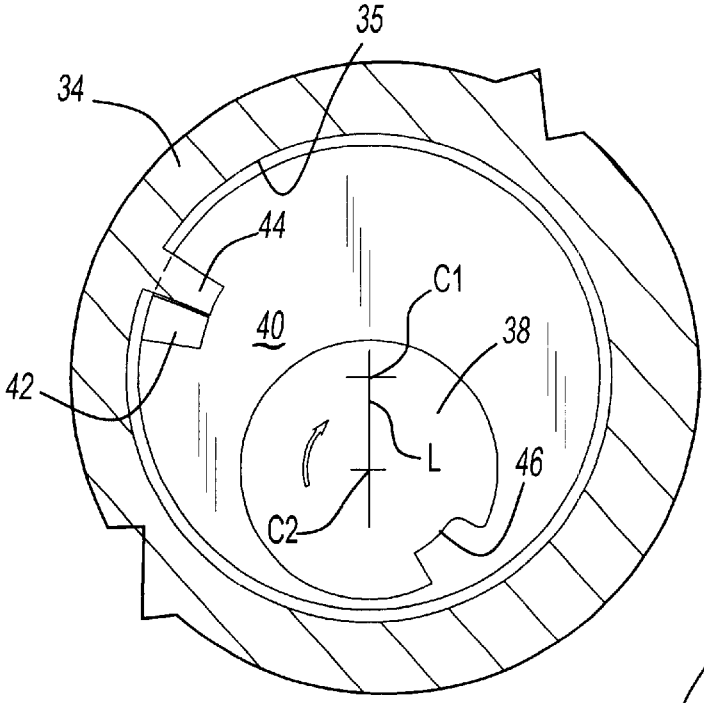
FIG. 2 shows the compressor with its anti-reverse rotation device in a normal position.

As shown in FIG. 2, the washer 40 has an outer diameter which is slightly smaller than the inner diameter of the bore 35. In the position illustrated in FIG. 2, the tab 42 has been driven in a clockwise direction against a housing stop 44. As the shaft end 38 is in contact with the washer 40, the washer 40 is urged in the clockwise direction against the stop when the shaft is driven in a forward direction. As shown also, the shaft has a notch 46 adjacent its lower end. When driven in the forward direction this notch remains empty.

As shown in FIG. 2, the center line Cl of the washer 40 is spaced from the center point C2 of the shaft 26. A line L is defined extending through those two center points.

Figure 3:
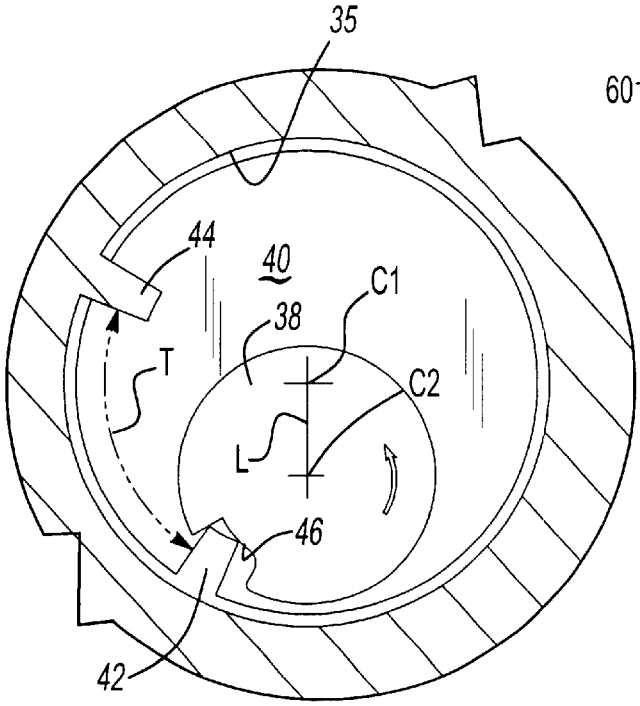
FIG. 3 shows the anti-reverse rotation device in a position blocking reverse rotation.

However, as shown in FIG. 3, if the compressor is driven in a reverse direction, then the end of the shaft 26 applies a force to bias or move the washer 40 in a counterclockwise direction. During this movement, the tab moves closer to the shaft end 38. As it does, it may initially contact the outer end of the shaft, and slow rotation. Eventually, the tab 42 will catch into the notch 46. At that point, the tab 42 will resist any further rotation of the shaft.

As shown in this figure, if the line L were extended through the center point C2 at the point when the tab 42 engages the notch 46, the tab has yet to cross the Line L. If left for unrestrained movement, the tab 42 would soon cross the Line L. However, due to the fact that when the tab 42 engages the notch 46 it has yet to cross the Line L, further movement of the tab 42 along its trajectory would be driven further into the shaft notch. In a sense, the tab is "diving in" to the shaft. The tab thus gets caught in the notch, and cannot dive any further in. The mechanism locks up. Thus, the present invention prevents reverse rotation of the shaft with a relatively inexpensive device. This device can be utilized in combination with the type of clutch normally utilized to prevent rotation of the orbiting scroll in unpowered reverse rotation, or the device can be utilized on its own.

Figure 4:
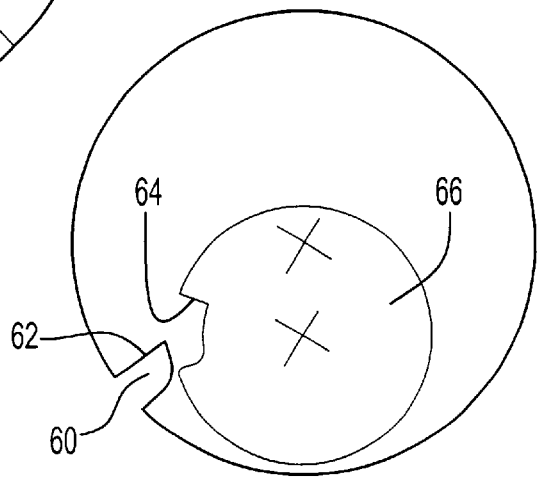
FIG. 4 shows another embodiment.

FIG. 4 shows another embodiment of this invention wherein the tab 60 has an angled surface 62 which slides within a mating angled surface 64 in the shaft 66. The exact shape of the tab and notch may vary.

A preferred embodiment of this invention has been disclosed, however, a worker in this art would recognize that certain modifications would come within the scope of this invention. For that reason the following claims should be studied to determine the true scope and content of this invention.

What is claimed is:

1. A scroll compressor comprising:

a first scroll member having a base and a generally spiral wrap extending from the base;

a second scroll member having a base and a generally spiral wrap extending from its base, said spiral wraps of said first and second scroll members interfitting to define compression chambers;

a drive shaft for causing said second scroll member to orbit relative to said first scroll member, said drive shaft being normally driven in a first direction; and a device for allowing rotation of said drive shaft when driven in said first direction, but engaging said drive shaft to prevent rotation when driven in a second direction opposed to said first direction, said device including a clutch at a first axial location on said shaft, said clutch allowing rotation in only said first direction, and a second device positioned at a second axial location, axially spaced from said first axial location of said clutch, said second device resisting rotation of said shaft in said second direction to a greater extent than said second device resisting rotation of said shaft in said first direction.

2. A scroll compressor as recited in claim 1, wherein said clutch is positioned between a drive transmission path for said second scroll member and a housing member to prevent orbiting movement of said second scroll member in said second direction.

3. A scroll compressor as recited in claim 1, wherein said second device is positioned against an end of said shaft remote from said first and second scroll members.

4. A scroll compressor as recited in claim 3, wherein said second device includes a washer applying a thrust force along said shaft.

5. A scroll compressor comprising:

a first scroll member having a base and a generally spiral wrap extending from said base;

a second scroll member having a base and a generally spiral wrap extending from said base, said wraps of said first and second scroll members interfitting to define compression chambers;

a drive shaft for driving said second scroll member to orbit relative to said first scroll member in a first direction when said drive shaft is driven in a first direction; and a washer positioned in abutting contact with an end of said shaft remote from said first and second scroll members, said washer having a tab extending upwardly toward said shaft, said tab being movable with said washer between an actuated and a non-actuated position, said tab abutting a housing stop when in said non-actuated position, and said tab catching an opening in said shaft when in said actuated position, said washer being driven to move said tab to said non-actuated position when said shaft is driven in said first direction, and said washer being driven to move said tab to said actuated position when said shaft is driven in a second direction opposed to said first direction.

6. A scroll compressor as recited in claim 5, wherein a center point of said washer and a center point of said drive shaft define a line, and when said tab engages said notch, said tab has yet to cross said line.

7. A scroll compressor comprising:

a first scroll member having a base and a generally spiral wrap extending from the base;

second scroll member having a base and a generally spiral wrap extending from its base, said spiral wraps of said first and second scroll members interfitting to define compression chambers;

a drive shaft for causing said second scroll member to orbit relative to said first scroll member, said drive shaft being normally driven in a first direction;

a device for allowing rotation of said drive shaft when driven in said first direction, but engaging said drive shaft to prevent rotation when driven in a second direction opposed to said first direction, said device including a clutch at a first axial location on said shaft, said clutch allowing rotation in only said first direction, and a second device positioned at a second axial location, axially spaced from said first axial location of said clutch, said second device resisting rotation of said shaft in said second direction;

said second device is positioned against an end of said shaft remote from said first and second scroll members;

said second device includes a washer applying a thrust force along said shaft; and said second device includes a tab which is movable within a housing, said tab abutting a stop on said housing when said shaft is driven in said first direction, and said tab being moved into a notch in said shaft when said shaft is driven in said second direction.

8. A scroll compressor as recited in claim 7, wherein said housing also mounts a bearing at a remote end of said shaft.

9. A scroll compressor as recited in claim 7, wherein said washer is mounted within a bore of a housing member.

10. A scroll compressor as recited in claim 9, wherein a center point of said washer and a center point of said drive shaft define a line, and when said tab engages said notch, said tab has yet to cross said line.

* * * * *

UNITED STATES PATENT AND TRADEMARK OFFICE

CERTIFICATE OF CORRECTION

PATENT NO. : 6,634,874 B2
DATED : October 21, 2003
INVENTOR(S) : Bush et al.

It is certified that error appears in the above-identified patent and that said Letters Patent is hereby corrected as shown below:

Column 4,
Line 27, insert -- a -- before "second scroll member…"

Signed and Sealed this

Thirteenth Day of January, 2004

JON W. DUDAS
*Acting Director of the United States Patent and Trademark Office*